United States Patent [19]

Robinet et al.

[11] 4,014,118

[45] Mar. 29, 1977

[54] INTERCHANGEABLE SIGN

[76] Inventors: Jules P. Robinet, 2865 Virginia Park; John Tamasovics, 2530 Todd Lane, both of Windsor, Ontario, Canada

[22] Filed: May 12, 1975

[21] Appl. No.: 576,667

[52] U.S. Cl. ..... 40/143

[51] Int. Cl.[2] ..... G09F 7/06

[58] Field of Search ..... 40/143, 129 C, 140, 40/133 B

[56] References Cited

UNITED STATES PATENTS

| | | | |
|---|---|---|---|
| 911,915 | 2/1909 | Stoll | 40/133 B |
| 1,455,474 | 5/1923 | Brown | 40/133 B |
| 1,719,540 | 7/1929 | Franks | 40/208 |
| 3,768,433 | 10/1973 | Dian et al. | 40/129 C |

FOREIGN PATENTS OR APPLICATIONS

| | | | |
|---|---|---|---|
| 619,297 | 3/1949 | United Kingdom | 40/208 |

*Primary Examiner*—John F. Pitrelli
*Attorney, Agent, or Firm*—Charles Krassov

[57] ABSTRACT

This invention relates generally to signs such as are used for house numbers, door plaques, and other identification items, and particularly to the type of signs in which the number or letters are removable and replaceable. The novelty of this invention resides in all the components, such as the outer frame, the background, and the numbers, letters, or symbols, being replaceable or interchangeable. The above mentioned components of the sign are combined by simple press fitting, or by means of a set of screws which are also used to attach the said sign to a wall or similar surfaces.

5 Claims, 7 Drawing Figures

INTERCHANGEABLE SIGN

This invention relates generally to signs such as are used for house numbers, door plaques, and other identification items, and particularly to the type of sign in which the numbers or letters are removable and replaceable. The novelty of this invention resides in all the components, such as the outer frame, the background, and the numbers, letters, or symbols, being replaceable or interchangeable. The above mentioned components of the sign are combined by simple press fitting, or by means of a set of screws which are also used to attach the said sign to a wall or similar surfaces.

Figure 1:
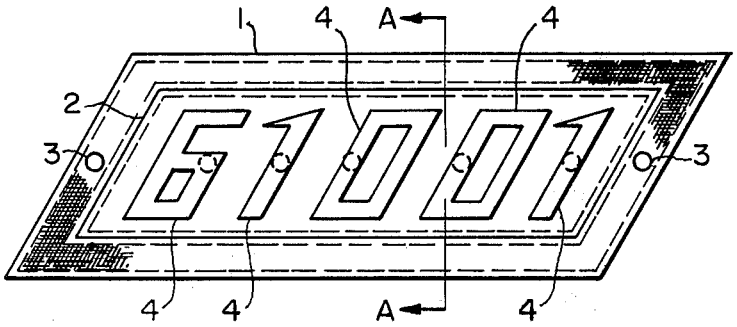
Figure 2:
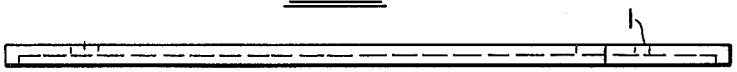
Figure 3:
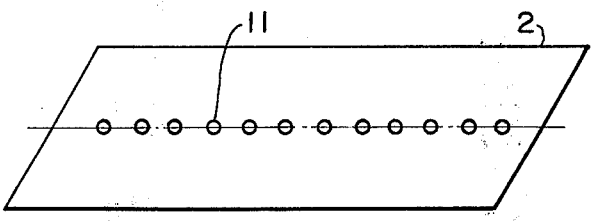
Figure 4:
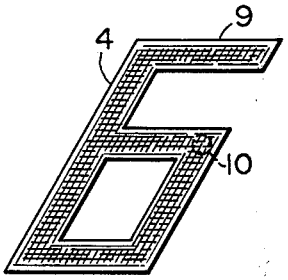
Figure 5:
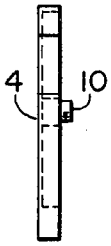
Figure 6:
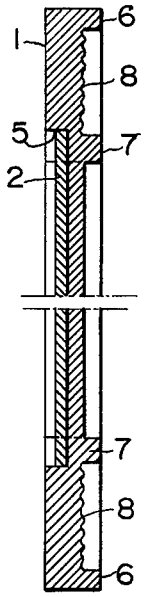
Figure 7:
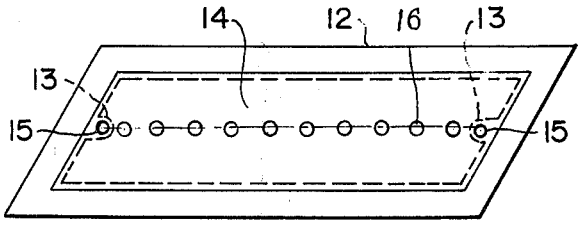

In describing the invention reference will be made to the attached drawings in which, FIG. 1 is a plan view of the invention, FIG. 2 is an edge view of the invention, FIG. 3 is a plan view of the background panel, FIG. 4 is an elevation of an interchangeable number, FIG. 5 is a side view of the number, FIG. 6 is section A—A of FIG. 1, and FIG. 7 shows a plan view of a variation in the invention.

The invention is shown in the drawings, by way of example, in the form of a parallelogram consisting of a frame 1, a background panel 2, and numerals 4.

The frame 1 is provided with holes 3, 3, by means of which the sign can be attached to a wall or any other flat surface. The frame 1 is provided in the rear thereof with a centrally located cavity 8 which is enclosed by a rim 6 on the outside thereof and an inner rim 7 on its inside. The cavity 8 is corrugated to provide a light reflective surface on the front of the frame. A grooved cavity 5 is provided in the face of the frame 1 into which is inserted the background panel 2 and is held therein by a press fit or by gluing.

The panel 2 is provided with a plurality of spaced holes 11 along its horizontal centerline. These holes are for the purpose of attaching the various letters or numbers such as number 61001, as shown in FIG. 1.

In FIG. 4, a sample number six is used to illustrate the construction of the letters or numbers 4. These are also provided with a corrugated cavity in their rear, in order to make such numbers or letters light reflective, as shown at 9. The letters or numbers 4 are provided in the rear with a short rounded pin 10, located along its horizontal centerline, by means of which the letter or number is attached to the panel 2, by pressing the pin 10 into anyone of the holes 11 which will provide proper spacing.

A variation in the invention is shown in FIG. 7. In this case the frame 12 is identical with frame 1, except that one pair of its parallel or opposite sides are provided on the inside with centrally located holed lugs 13, 13, by means of which the completed sign can be attached to a wall. The panel 14, in this case, is provided with holes 15 which line up with the holes in the lugs 13, so that a nail or screw which passes through these holes can fasten both the panel and frame simultaneously. The panel 14 is also provided with a row of centrally located holes 16 which correspond to the holes 11 in the panel 2.

All components of the sign are made of a moulded plastic material so that the frames 1 and 12, the panels 2 and 14, and the letters or numbers 4, can be made of various colors and color combinations, mottled colors, and imitation wood or metals.

Because the invention is made of moulded plastic material, the holes 11 and 16 do not go entirely through their respective panels, but a thin film is left covering the back part of the holes so that any holes which are not used remain somewhat invisible. The thin film in each hole is easily punched out by the pin 10, when the numbers are inserted.

Furthermore, the complete sign can be made in an indefinite number of shapes and sizes, with letters or numbers to correspond with the general design of the sign.

Having described my invention what I claim is:

1. A sign made of plastic material and having replaceable and interchangeable components, comprising in combination a planar light reflecting frame which is provided with a plurality of holes for attaching said sign to a wall, and grooved interior rims on both sides of the frame so as to define front and rear cavities there within; a background panel to matingly press fit into said grooved rims of the frame, said panel being provided with a plurality of equally spaced apertures, located along the horizontal or vertical centerline of said panel, each aperture containing a readily severable thin film therein of the same plastic material as that of the panel; and various numbers, letters, or symbols which can be removably attached to said panel to form single or multiple numbers or words, said letters or numbers each being provided with a central cylindrical pin within a corrugated cavity in the rear thereof, said pin being sized to matingly engage as by being press fitted into said panel apertures for attaching said letters or numbers to one of said panels after mating within said front cavity of the frame.

2. A sign such as described in claim 1 in which the frame is provided on its interior rim with holed lugs by means of which said sign can be attached to a wall; and having a background panel which is provided with holes which line up with the holes in said lugs so that the frame and its panel can be simultaneously attached to a wall by nails or screws common to both the frame and its panel.

3. A sign such as described in claim 2 in which said frame, panel, and letters or numbers, are made in different color combinations.

4. A sign such as described in claim 1 in which said background panel is glued to said frame.

5. A sign such as described in claim 1 in which said frame, panel, and letters or numbers are made in different color combinations.

* * * * *